US006282859B1

(12) United States Patent
Van Der Heijden

(10) Patent No.: US 6,282,859 B1
(45) Date of Patent: Sep. 4, 2001

(54) BUILDING SYSTEM COMPRISING INDIVIDUAL BUILDING ELEMENTS

(76) Inventor: Franciscus Antonius Maria Van Der Heijden, Lindendree 5, B-2470 Retie (BE)

( * ) Notice: Subject to any disclaimer, the term of this patent is extended or adjusted under 35 U.S.C. 154(b) by 0 days.

(21) Appl. No.: 09/403,448

(22) PCT Filed: Apr. 2, 1998

(86) PCT No.: PCT/EP98/02125

§ 371 Date: Mar. 6, 2000

§ 102(e) Date: Mar. 6, 2000

(87) PCT Pub. No.: WO98/48126

PCT Pub. Date: Oct. 29, 1998

(30) Foreign Application Priority Data

Apr. 21, 1997 (NL) ..... 1005850

(51) Int. Cl.[7] ..... E04B 2/08

(52) U.S. Cl. ..... 52/585.1; 52/223.7; 52/233; 52/740.1; 403/305

(58) Field of Search ..... 52/223.1–223.7, 52/233, 726.1, 711, 740.1; 403/305, 307, 343, 314; 82/223.9, 223.12

(56) References Cited

U.S. PATENT DOCUMENTS

| | | | | |
|---|---|---|---|---|
| 2,971,295 | * | 2/1961 | Reynolds | 52/223.7 |
| 5,308,184 | * | 5/1994 | Bernard | 52/726.1 X |
| 5,392,582 | * | 2/1995 | Abukawa | 52/726.1 |
| 5,570,549 | * | 11/1996 | Lung et al. | 52/223.5 X |
| 5,689,923 | * | 11/1997 | Winkeljann et al. | 52/726.1 X |

FOREIGN PATENT DOCUMENTS

| | | | | |
|---|---|---|---|---|
| 165856 | * | 12/1985 | (EP) | 52/223.7 |
| 1062502 | * | 4/1954 | (FR) | 52/223.7 |
| 1-182465 | * | 7/1989 | (JP) | 52/740.1 |

* cited by examiner

*Primary Examiner*—Richard Chilcot
(74) *Attorney, Agent, or Firm*—Cohen & Grigsby P.C.

(57) ABSTRACT

Building system comprising individual building elements (1), each element having an upper and a lower surface which are substantially parallel to each other and each building element having at least one opening (10, 11) extending from the upper surface to the lower surface, the building elements being such that they can be positioned on top of each other so that openings of different elements are aligned with respect to each other, characterized in that in each opening a connecting element (30) can be placed by means of which the building element belonging to it can be connected with a predetermined pressure to the building element located immediately below the first building element.

9 Claims, 6 Drawing Sheets

BUILDING SYSTEM COMPRISING INDIVIDUAL BUILDING ELEMENTS

The invention relates to a building system comprising individual building elements, each element having an upper and a lower surface which are substantially parallel to each other and each building element having at least one opening extending from the upper surface to the lower surface, the building elements being such the they can be positioned on top of each other so that openings of different elements are aligned with respect to each other, and wherein a connecting element can be placed in each opening whereby a first building element belonging to it can be pressed to a second building element located immediately below the first building element, which connecting element of each first building element acts on the upper surface of that first building element and is connectable to the connecting element belonging to the second building element.

In the actual building systems the building elements or building blocks are positioned on top of each other whereby the building elements or building blocks can be connected to each other by different systems. In the most traditional system use is made of cement in order to connect two building elements which are positioned on tip of each other or are put side by side. In other systems, commonly called quick building systems, use is made of liquid or paste-like glues in order to connect the building elements to each other. In these systems the building elements according to the preamble can be used as well, the openings being made either to reduce the weight of the building elements and improve the insulating characteristics, or to accommodate lines or the like, or to increase the active surface for the glue or the cement.

The known building systems all have the disadvantage that they are unsuitable fo the unskilled man. During the placing of the building elements and the mutual connecting, the building elements must be positioned accurately with respect to each other and simultaneously they must be connected to each other. This requires the preliminary instalment and positioning fo adjusting profiles, a wire being stretched there between at the right level along with the next layer of building elements can be positioned and connected. The connection of the building elements requires the availability of a connecting agent such a cement of glue. The handling thereof is not always easy for the unskilled man, as specific requirements must be met with respect to the physical properties during its application, especially with respect to its viscosity. This all has resulted in the fact that the building of walls and the like is not done by the do-it-yourself man, but that as a rule the help of a skilled man is invoked to fulfil this task. Further the traditional building systems as a result of the connecting means used have the disadvantage that the building height of a wall per time unit is restricted, as the connecting agent needs some time to harden and to obtain the required strength before additional height can be added. When afterwards a building made out of traditional building elements must be broken down, the renewed used of the building elements is generally impossible or labour intensive and therefor not very effective. The cement or the glue must be seen as waste whereas the building elements only partly and only with great efforts can be made suitable for renewed use. In most cases a substantial portion must be accepted as waste.

In FR-A-2.473.590 there is disclosed a building system as described in the preamble of claim 1. In this known system each building element is provided with grooves extending around the building element. When two building elements are placed on top of each other with the groove in the lower surface of the top element in line with the groove in the upper surface of the bottom element, a first connecting element can be provided having a strip-like shape with an upper and lower groove provided with holding means. A second connecting element can be snapped in the lower groove of the first connecting element and the upper groove of a lower first connecting element, thereby pressing together the different building elements. The second connecting elements are positioned in the portion of the grooves on the side walls of the building element.

This known system has the disadvantage that the connection between the different layers is made by so-called saw-teeth connections (ratchet teeth) allowing only very discrete positioning of the connecting elements, and thereof on irregular pressure distribution between the different layers of the building elements. As a result thereof it is somewhat unpredictable whether two super-imposed building elements have been pressed together with the required pressure to ensure a sufficient stability of the erected wall.

In FR-A-1.487.332 there is also described a system as disclosed in the preamble of the main claim. Herein the connecting element is formed as a bolt one end being a threaded en and one and being shaped as a nut, with greater cross-section. The vertical openings in the building element are shaped as bores and between the bolt and the wall of the bore an elastically deformable material has been provided.

Upon screwing one bolt on top of another already positioned inside a bore will the elastic material surrounding it, this elastic material is deformed and pressed against the wall of the bore. In this way the connecting elements or bolts are unified with the building elements, and this allow the different building elements on top of each other to be pressed together.

It might be possible to press two superimposed building elements together with a defined force but no information is given about that. Otherwise the fixation of the connecting element to each individual building element will generate important forces on the material of the building element. As these lateral forces generate tensions in the material of the building element it is highly susceptible to break, and thereby loosing the fixation. This is especially the case with building materials such as cement, which normally have a very low resistance against tension forces.

It is an object of the invention to provide a building system as elucidated in the preamble wherein the above mentioned disadvantages are avoided.

This object is achieved in that a deformation member has been applied between the lower surface of the first building element and the connecting element of the second building element, which is deformed by a first predetermined force, thereby inducing a stress in the connecting element of the first building element, and that each first building element is pressed with a second predetermined force to a second building element.

Other characteristics and advantages of the invention will become clear from the following description, reference being made to the annexed drawings in which.

Figure 1:
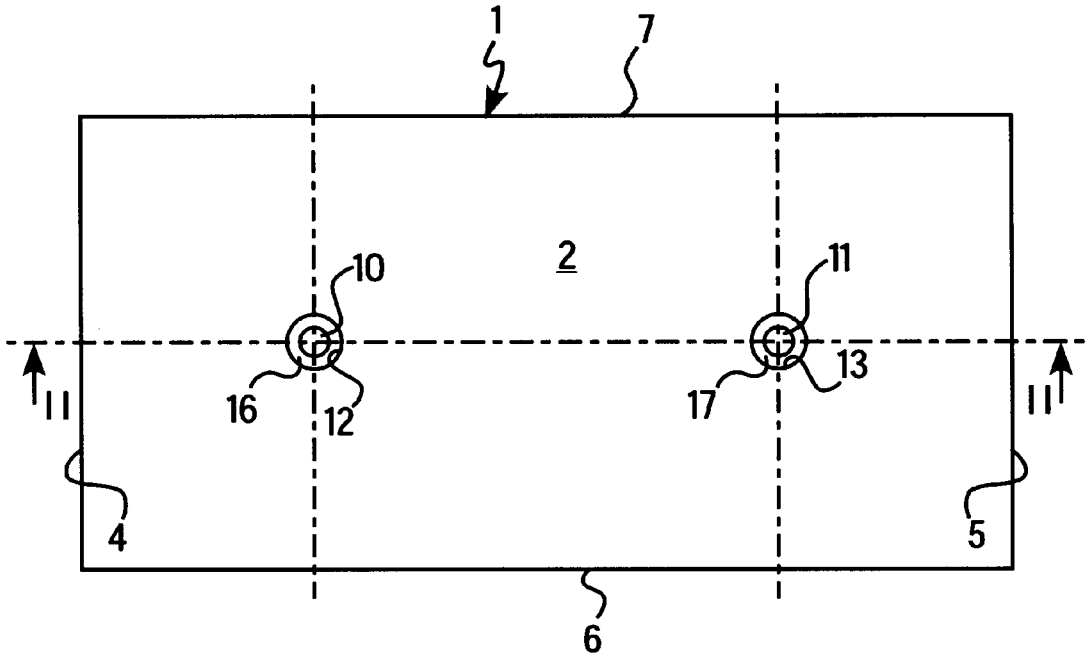
FIG. 1 is a top view of a building element which can be used in a building system according to the invention.
Figure 3:
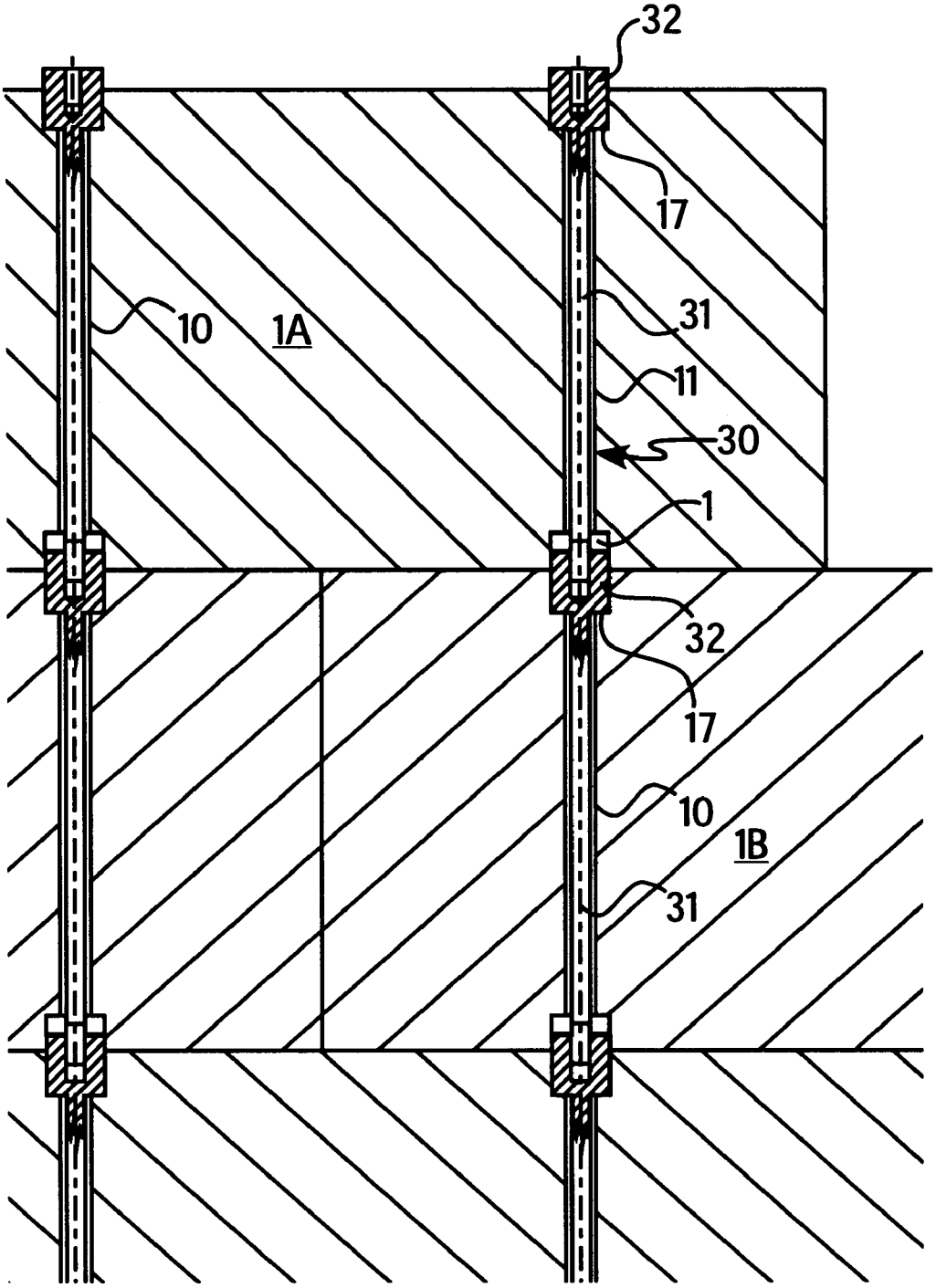
Figure 4:
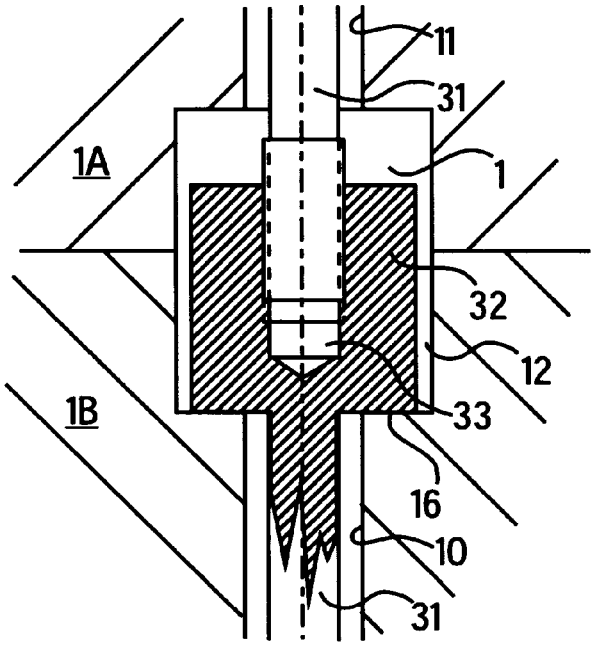
Figure 6:
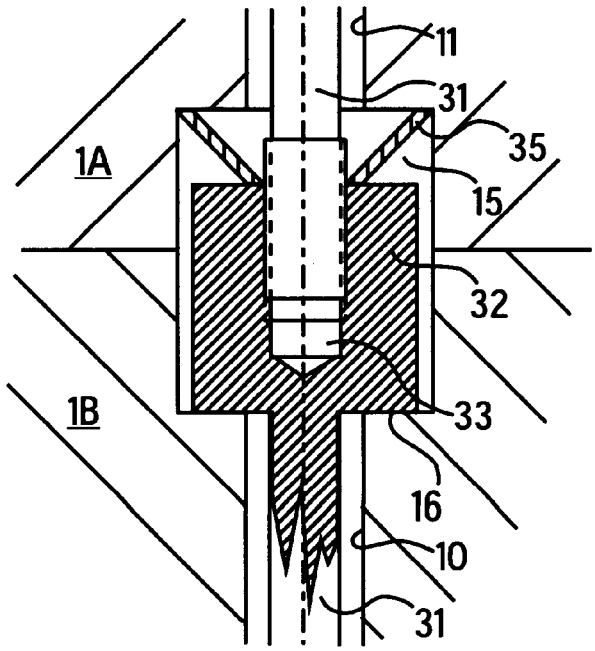
Figure 5:
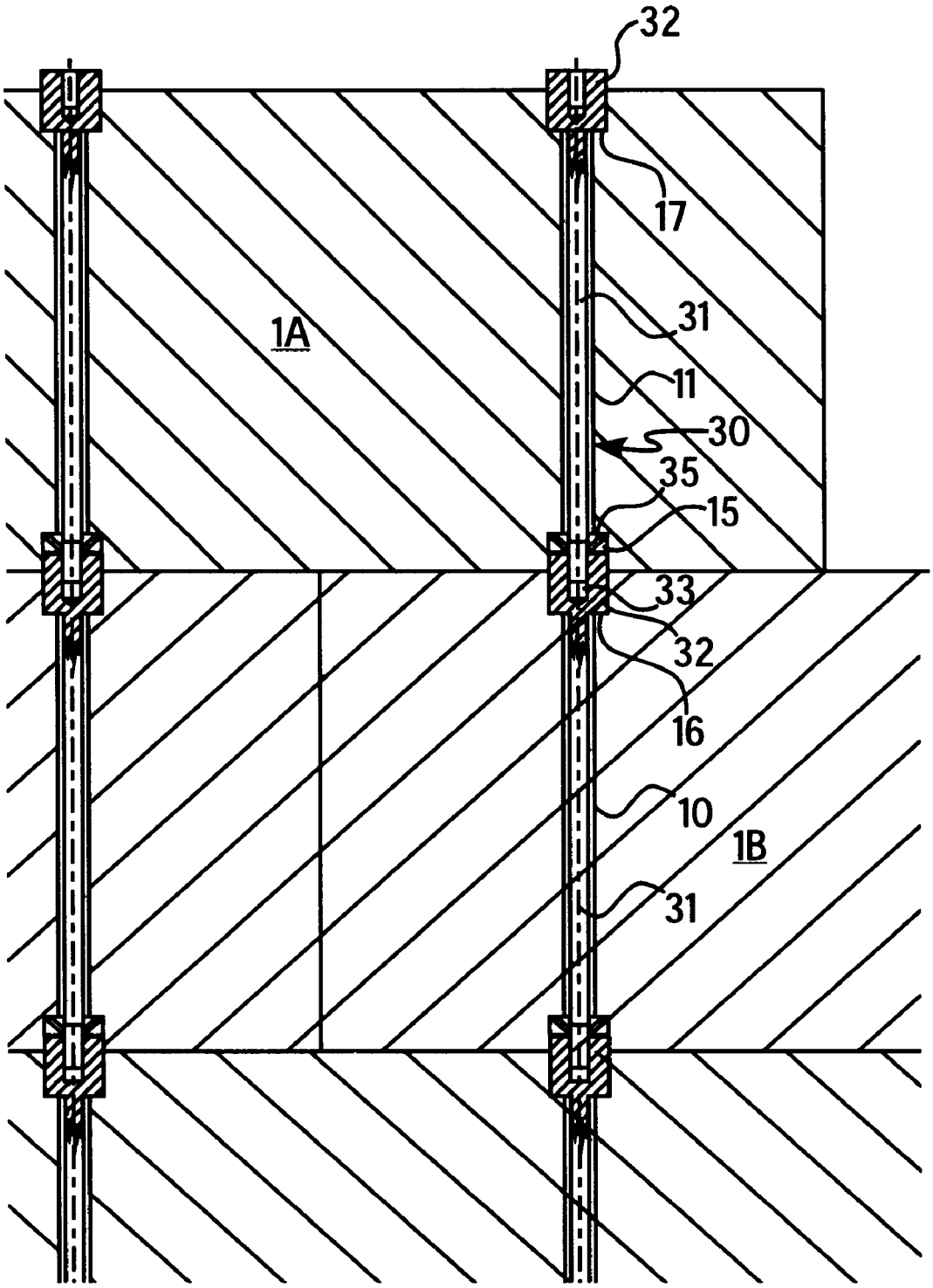
Figure 7:
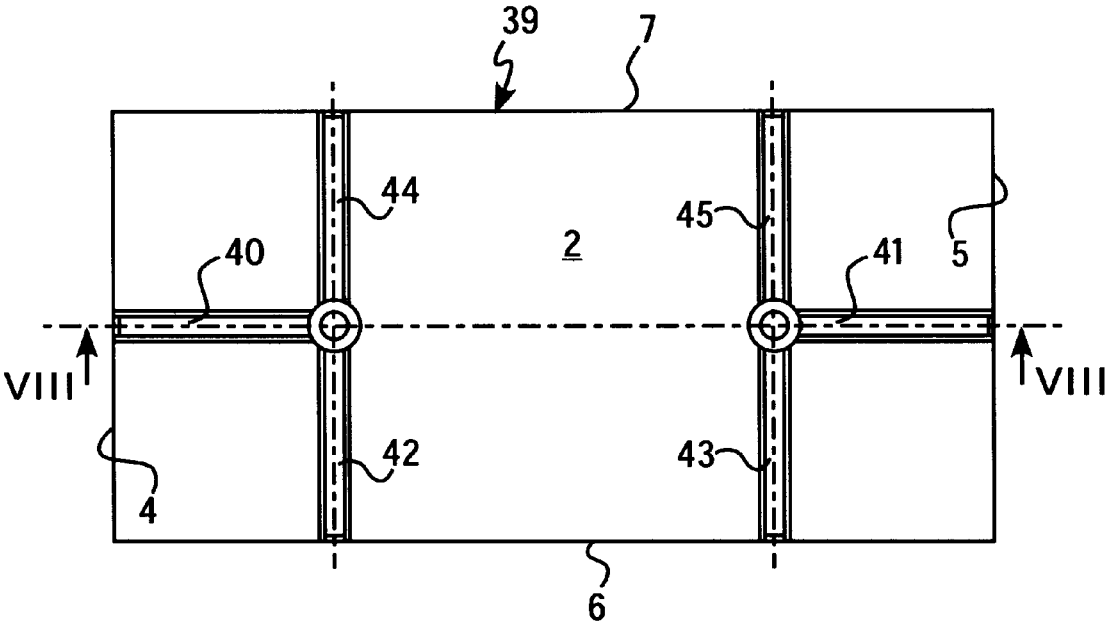
Figure 8:
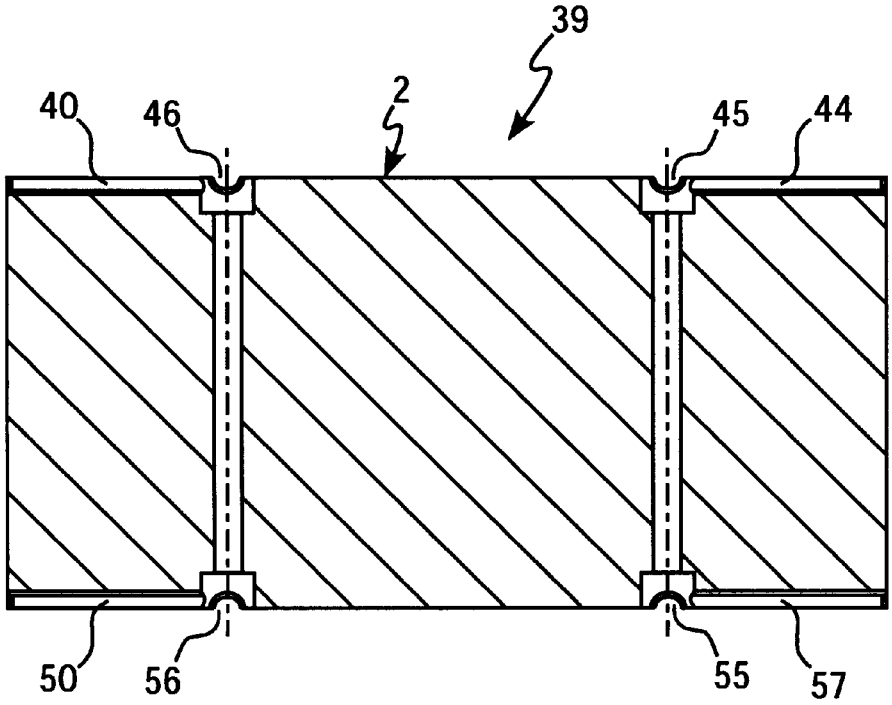
Figure 9:
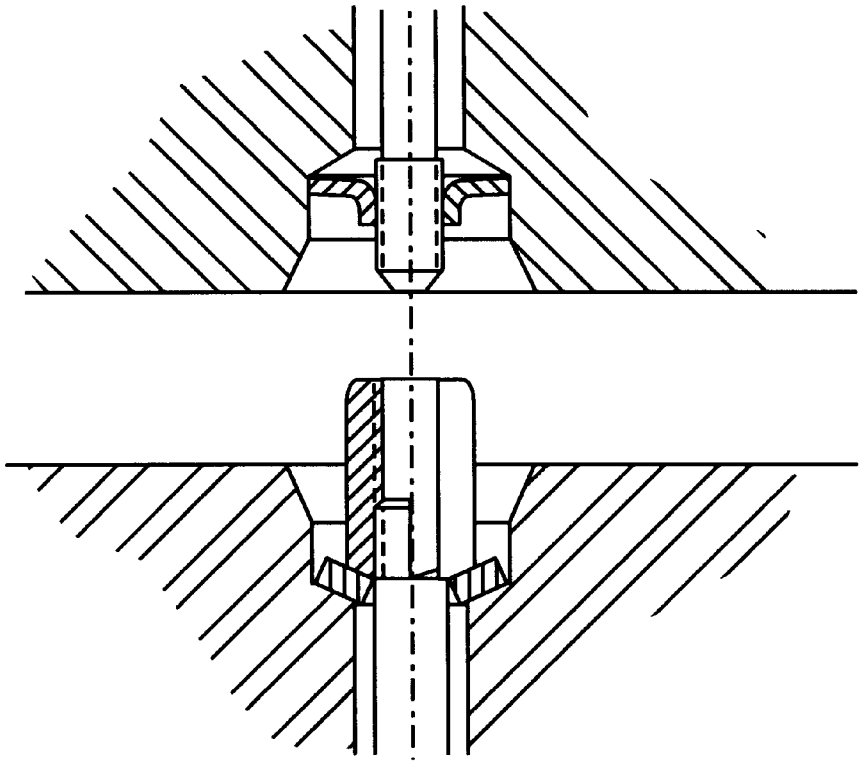
Figure 10:
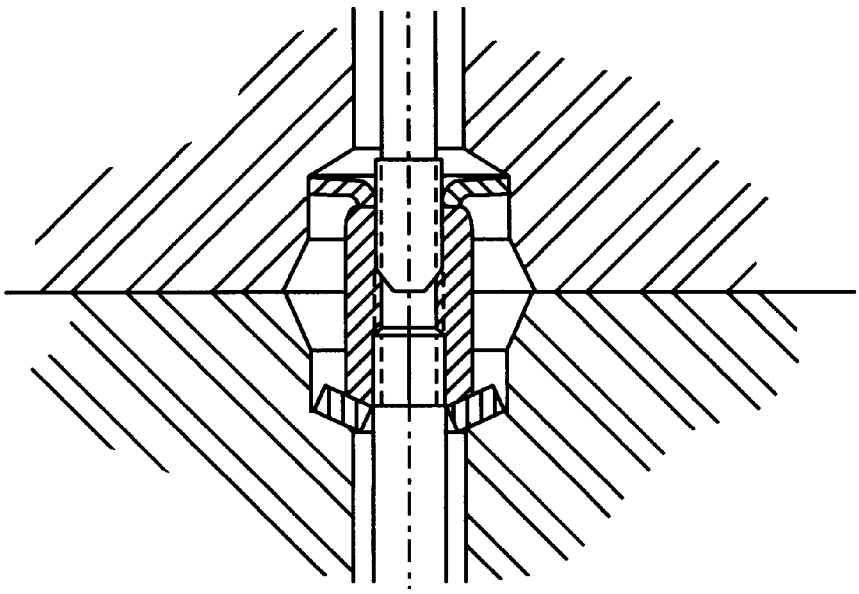

FIG. 3 is a schematic cross section of a number of superimposed building elements which are connected to each other by means of the system according to the invention, FIG. 4 is a cross section, on enlarged scale, of the connecting place between two building elements, the connection being made according to the invention, FIG. 5 is a cross section corresponding to the cross section of FIG. 3 of a second embodiment of a building system according to the invention, FIG. 6 is a cross section corresponding to the cross section of FIG. 4 of the second embodiment of the building system according to the invention, FIG. 7 is a top view of a building element according to the invention which is modified with respect to the embodiment of FIG. 1, FIG. 8 is a cross-section according to the line VIII—VIII in FIG. 7, FIG. 9 a view corresponding to the view of FIG. 6 of a third embodiment of a connecting system for the building system according to the invention, shown in the condition before the real connection takes place, and FIG. 10 a view corresponding to the view of FIG. 9, after the two building elements have been connected to each other.

Figure 2:
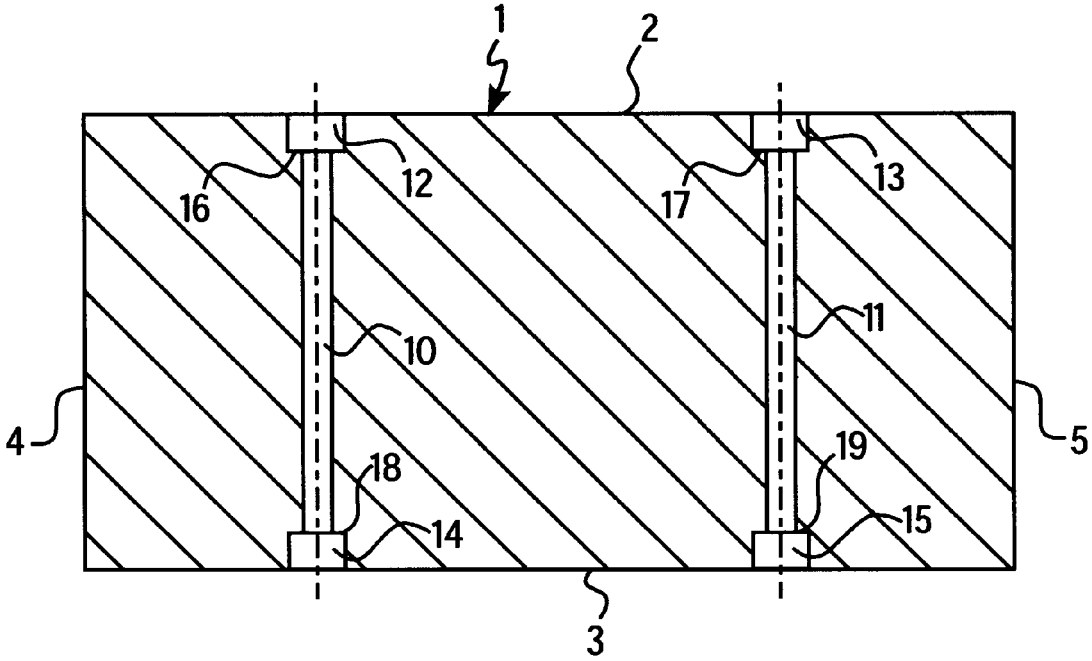
FIG. 2 is a cross section according to the line II—II in FIG. 1.

In the FIGS. 1 and 2 there is shown a building element 1 which can be used for realizing the building system according to the invention. In the embodiment shown the building element 1 has the shape of rectangular block, having an upper surface 2 and a lower surface 3, two short side walls 4 and 5 and two long side walls 6 and 7. This building element 1 can be made out of a number of materials, such as natural materials as used in the traditional building blocks, e.g. bricks, as thermoplastic or resin-type materials. Preferably the building element is made out of sand-lime or concrete, as these materials present the required combination of correct measurements, low cost-price en suitable thermal, mechanical and acoustic properties.

In order to be able to connect the building elements 1 to each other so that a building system is obtained, each building element 1 is provided with at least one opening extending from the upper surface 2 until to the lower surface 3. In the description and also in the drawings the expression opening is used, and in the further description this opening has the shape of a bore with circular cross-section. However it should be clear that the invention is not restricted to circular bores, but that basically any opening extending between the two named surfaces having any cross-section can be used. In the embodiment shown two such openings 10 and 11 have been provided. The ends of the openings 10 and 11 located near to the upper surface 2 are provided with cut-outs 12 and 13 having a cross-section which is larger than the cross-section of the openings 10 and 11, and the cut-outs 12 and 13 are concentric with respect to the openings 10 and 11. In the same way and close to the lower surface the openings 10 and 11 are provided with cut-outs 14 and 15, which in the embodiment shown have the same shape as the cut-outs 12 and 13, but in principle they can have a different shape and in some circumstances they can left out completely. In this way the end portions of the openings 10 and 11 are provided with shoulders 16, 17, 18 and 19.

In order to connect two building elements 1 to each other two such elements 1A and 1B are put on top of each other one of the openings 10 or 11 of the one element 1A being positioned in line with one of the openings 10 or 11 of the other element 1B., and the lower surface of the element 1A resting on the upper surface of the other element 1B, as shown in FIGS. 3 and 4.

For the connection of two building elements 1A and 1B which are put on top of each other, use is made of a connecting element 30 as shown in FIG. 3. In the embodiment shown the connecting element 30 comprises a rod 31 which has one end provided with an enlarged portion 32 by means of which the connecting element can rest against one of the shoulders 16, 17, 18 or 19 in the openings. The enlarged portion 32 can constitute one unit with the rod, but it might also be a separate unit which during the erection of the wall is provided each time to the end of the rod 31. The enlarged portion 32 is provided with means for accommodating the end of another rod 31, in such a way that the two rods are fixed to each other. In the embodiment shown the enlarged portion 32 as seen in the axial direction of the rod is provided with a bore 33 which is provided with a thread, and the rod 31, or at least the end portion thereof is provided with a thread of the same pitch, the diameter of the thread of the bore 33 corresponding to the thread of the rod 31. The external surface of the enlarged portion 32 can have the shape of an hexagonal nut, so that it fits to tools by means of which the rod 31 can be screwed on. The length of the connecting element 30 is basically equal to the height of the building element plus the length of the thread portions extending into the enlarged portion 31 of the next connecting element. The diameter of the rod is somewhat smaller than the diameter of the openings 10 or 11, so that the rod can be inserted through the openings 10 or 11 with some tolerance.

In order to connect two building elements which are put on top of each other as described above, a rod 31 is inserted through the opening 10 or 11 positioned in line with the opening 10 or 11 of the building element positioned below the first mentioned, so that the enlarged portion 32 is protruding at the upper part. In the assumption that in the opening of the lower building element such a connecting element 30 has already be provided, the now inserted rod can be screwed in the thread of the lower connecting element. By selecting the right dimensions of the building element and the connecting element 30 the rod can be screwed on to such an extent that the last positioned building element is pressed between the enlarged portion 32 of its own connecting element 30 and the upper surface 2 of the lower building element 2B. By using a suitable tool the force of this pressing can be adjusted to a defined value, e.g. a force of 3000 N so that the composition receives enough pre-stress in a direction perpendicular to the contact surface and friction along this surface, in order to meet (apart from the pressure resulting of the piling up) all cross stresses, bending-stress and local stress as may be expected.

In FIG. 3 there is schematically shown how a number of buildings elements are connected to each other by means of the connecting elements 30. From this drawing it becomes clear how a wall can be obtained in which all the elements are pressed to each other with the same force. Measurements have shown that basically a force of 1000 N is sufficient to give the wall enough strength against lateral forces. Preferably however greater pressure forces between the building elements are used, e.g. of the magnitude of 3000 N. In this way a solid and secure wall can be obtained. With respect to the anchoring it must be remarked that the lowermost layer of building elements can be fixed to a fundament by means of the connecting elements 30, the fundament being already made before erecting the wall and being provided with hollow elements provided with thread for accepting the lower ends of the rods 31. If needed the rods 31 of the lowest layer can be longer than the standard rod length.

In case the height of the enlarged portion 32 is smaller than the height of the shoulder 12 or 13, the enlarged portion 32 falls completely within in the shoulder 12 or 13 and the shoulders 14 and 15 at the lower surface of the building elements can be eliminated. In view however of the positioning of the next building element to be placed it is preferred that the enlarged portion 32 is extending somewhat above the upper surface 2.

In the embodiment described above problems may arise when one of the rods 31 breaks, whereby the complete tension force over the height of the wall above the fracture disappears. This can be improved by anchoring at least partly each building element to the building element or elements located above it. How this can be achieved is described with respect to the FIGS. 5 and 6.

The system as shown in FIGS. 5 and 6 is substantially identical to the system as shown in FIGS. 3 and 4, except for the presence of a deformation element 35 which has been positioned between the enlarged portion 32 and the shoulder 19 of the cut-out 15. In the embodiment shown the deformation element is a ring with a truncated conical shape. The dimensions and the material of the deformation element 35 are selected in such a way that the element as a result of a predetermined force, e.g. 1000 N is deformed in a non-elastic permanent way. It is clear that the invention is not restricted to the embodiment of the deformation element shown, but that it is possible to use other type of deformation elements. Essentially the operation of the deformation element 35 must be such that as a result of a predetermined force a permanent non-reversable deformation is taking place, which force must be substantially smaller than the force whereby the superimposed building elements must be pressed together.

The dimensions of the deformation element 35 are selected in such a way that in horizontal direction it completely fits within the cut-outs 12, 13, 14 and 15. The vertical dimension in undeformed condition must be such that the sum of the height of the enlarged portion 32 and the height of the deformation element 35 is bigger than the sum of the heights of the cut-outs 12 and 14 or 13 and 15. If theses conditions are met the following function is obtained.

It is assumed that the building system is already composed of a number of layers. Before a new building element is positioned with his openings 10 and 11 in register with the openings 10 and 11 of the building element located immediately below the first one, a deformation element is placed on each enlarged portion 32 which will be used by this new building element for connecting purposes. After positioning of the building element, the connecting elements 30 are inserted through the openings 10 and 11 which extend through the already available deformation elements 35 until to the upper end of the bores 33 in the enlarged portions 32. When thereupon the connecting element 30 is screwed into the bore, the enlarged portion 32 of this connecting element 30 is brought into contact with the shoulder 16 or 17. From this moment on further screwing of the connecting element 30 will cause the building element to be pressed in the direction of the lower building element. In view of the dimensions as elucidated above this means in the first place that contact is made between the deformation element and the shoulder 18 or 19. As soon as the pressure has reached a defined value, e.g. 1000 N, the deformation element starts deformation until the lower surface of the upper building element is contacting the upper surface of the lower building element. Further screwing of the connecting element 30 will cause the two surfaces to be pressed together until the desired pressure force of e.g. 3000 N has been reached. From this moment on the deformation element 35 is deformed and squeezed between the shoulders 18 or 19 on the one hand and the enlarged portion 32 of the connecting element 30 on the other hand. Thereby the deformation element presses with a force of 1000 N against the shoulder 18 or 19.

In this way it is achieved that each connecting element 30 is anchored on its own and that the force over the height of a number of superimposed building elements is not completely transferred to the lower connecting element. When now for any reason one of the connecting elements is broken or is not any more capable to transfer the stress downwardly, the required stress force in a number of layers is sufficiently built up to guarantee the required anchoring of the system. In view of the large number of connecting elements which e.g. is present in a wall made by means of the building system according to the invention, the consequences in case of an interruption in one of the vertical connecting elements are restricted to a local event, which can not extend to the complete height of the wall.

In a number of situations it might be desirable to increase the lateral strength of a wall made by means of the building system according to the invention. This can be the case with high walls or in order to connect the inner walls to the outer walls in a construction having a hollow wall. In these situations use can be made of the building element as shown in FIGS. 7 and 8.

The building element 39 according to the FIGS. 7 and 8 is substantially identical to the building element according to FIG. 1, except for the fact that the upper and lower surface have been provided with gutters having a semi-circular or U-shaped cross-section. The gutters 40, 41, 42, 43, 44 and 45 extend from the edges between the upper surface 2 and the side-walls 4, 5, 6, and 7 to the cut-outs 12 and 13 in the upper surface 2. It is possible that the gutters 40 and 41, 42 and 44 and 43 and 45 are extensions of each other and can emerge into each other. In the same way the lower surface 3 is provided with gutters 50, 51, 52, 53, 54 and 55 which also extend from the edges between the lower surface 3 and the side-walls 4, 5, 6 and 7. In the embodiment shown each gutter 40–45 and 50–55 is provided with a thread. The location of the gutters 40–45 and 50–55 is chosen in such a way that when two building elements 39 are placed on top of each other with their openings on one line, at least one gutter in the lower surface of the upper building element is directly opposite one gutter in the upper surface of the lower building element, so that it looks as if one bore provided with thread has been formed. Neighbouring building elements may have corresponding bores located on one line with these bores.

The operation of the lateral anchoring is as follows. During the erection of the wall two building elements 39 are positioned along each other their upper surface being on the same height and the gutter 41 being aligned with the gutter 40 of the neighbouring building element. In this way a nearly common gutter is shaped in the common upper surface of the two building elements. In this gutter a rod provided with thread can be placed in such way that it co-operates with the thread in the gutters 41 and 40 respectively. The positioning of the next layer of building elements 39 is done in such a way that at least one of the gutters 50 or 51 is fitting upon the threaded rod which is placed in the gutters 41 and 40 so that the rod is completely enclosed and a lateral anchoring is formed between the two building elements. There is no need that the building elements are directly in contact to each other. It is possible that two walls together forming a hollow wall are laterally fixed to each other. Further this provides the freedom to adapt the number of lateral anchoring in the height depending upon the circumstances, e.g. by providing lateral anchoring in each layer at the critical levels, and only in defined layers in less critical levels,.

Furthermore it is possible to use other lateral anchoring than the system with threaded rods as described above. So it is possible to use gutters 40–45 and 50–55 respectively in which at a defined distance from the edges between the upper surface 2 and the lower surface 3 respectively and the sidewalls 4, 5, 6 and 7 there are provided cut-outs having a bigger dimension than the cross section of the gutters. The anchoring can take place by means of rods which at both ends are provided with correspondingly shaped enlarged portions. In the most simple embodiment this can be achieved by providing in each gutter at a defined distance from the side walls a bore, cross hole or other enlarged hole perpendicular with respect to the surface of the upper surface 2 or lower surface 3 respectively. The anchoring element may comprise a rod having two end portions bent over an angle of 90°. If such an embodiment is chosen it may be enough to provide a cut-out only in the upper surface or the lower surface. In the same way the threaded bore formed by the two threaded gutters made symmetrically in the upper and lower surface may be substituted by asymmetrical shaped gutter-like holes. This can be achieved by means of a U-shaped gutter in which is threaded rod is completely incorporated and fixed, closed by the completely flat surface of the other building element. A threaded rod can, contrary to a spacing rod (made of bent iron wire), be installed and removed without disassembling the building elements.

In the FIGS. 9 and 10 a third embodiment of the building system according to the invention has been shown. This embodiment differs from the embodiments described above in that the connecting element is made out of several parts and by the shape of the deformation element. At the same time the shape of the openings in the building elements has been adapted.

The cut-outs 115 and 112 in the building elements 101A and 101B shown in FIGS. 9 and 10 correspond to the cut-outs 15 and 12 in the building elements 1A and 1B of the FIGS. 3 and 4. The cur-out 115 consists of a conical outer part 160, a cylindrical intermediate part 161 and a conical bottom part 119 corresponding to the shoulder 19 in FIG. 2. In the same way the cut-out 112 is composed out of an outer part 170, an intermediate part 171 and a bottom part 116.

The connecting element consists of a rod 131 which at least near to its ends is provided with thread. The length of the rod corresponds substantially to the height of the building element 101. Further the connecting element comprises a nut 180 with a height somewhat lesser than the sum of the depths of the cut-outs 112 and 115. The internal threads of the nut 180 is halfway provided with a stop or the like, whereby it is prevented that the thread end of the rod 131 can be further screwed into the nut 180. The deformation element 181 consists of a ring the central opening of which has a diameter which substantially corresponds to the outer diameter of the rod 131, an upright edge 182 being formed around the opening, in such a way that the ring can be slipped over the thread end of the rod with some light clamping force. The outer diameter of the ring is substantially equal to the diameter of the intermediate part 161 and 171 of the cut-out 115 and 112 respectively. Further a closing ring 184 is used with a conical shape which nearly fits to the conical shape of the bottom part 119 and 116 respectively.

In order to describe the operation of this embodiment, the starting point is the situation as shown in FIG. 9, wherein it is assumed that the building element 101B through the rod 131, the nut 180 and the ring 184 is pressed against the building element located below it. In order to position the next building element the rods 113 are inserted into the openings 110 and 111 thereof, whereas at the same time over the lower end of the rods 131 there is placed a ring 181 and over the upper end a ring 184 and the nut 180 is loosely screwed to the upper end. In this way the connecting elements remain in position during the manipulation of the building element. If needed the building element can already be prepared in this way during the production of the building elements and being supplied in this form. Thereupon the building element 101A is placed on top of the building element 101B in such a way that the lower end of the rod 131 can be screwed into the nut 180 relating to the building element 101B. By means of a suitable tool fitting to the nut 180 screwed onto the rod 131 of the building element 101A, the nut is initially screwed further on the upper end, until it reaches the internal stop, after which the rod 131 starts to turn together with the nut. During further screwing the ring 184 will contact the bottom part 116. In this way it is obtained that the rod 131 is centralized in the opening 110. During further screwing of the nut and rod the upper end of the nut 180 will press against the deformation element 181. After reaching a defined pressure force, e.g. of 1000 N the element 181 will deform in such a way that ultimately it is compressed between the nut 180 and the bottom part 119. At the same time the building element 101A is pressed against the building element 101B until the pressure force has reached a value of e.g. 3000 N. Further screwing of the nut and the rod is stopped. FIG. 10 shows how the combination of ring, nut and deformation element are positioned after the screwing of the nut and rod has been terminated.

It is clear that in this way an anchoring of the building elements has been obtained which practically corresponds to the system described with respect to FIGS. 5 and 6. The advantage of the third embodiment is that the connecting element is completely composed of parts which are normally commercially available and therefor need not to be manufactured in a special way. This may result in a substantial saving in the cost price.

It will be clear that the invention is not restricted to the embodiments described and shown in the drawing, but that numerous modifications can be applied within the scope of the inventive idea such as expressed in the claims.

What is claimed is:

1. A building system comprising a plurality of individual building elements and connecting elements, each of said building elements having an upper and a lower surface which are substantially parallel to each other and having at least one opening extending from the upper surface to the lower surface, each of said building elements being adapted for alignment with respect to an opening in another building element, each of said connecting elements being dimensioned to fit within and extend through an opening in a building element, each of said connecting elements interconnecting a pair of associated building elements and a deformation member, said deformation member being positioned between a lower surface of a first building element and a connecting element of a second building element, said deformation member being deformable by a predetermined force to induce a stress in said connecting element of said first building element such that each of said first building elements is pressed with a second predetermined force to a second building element.

2. A building system according to claim 1, characterized in that the connecting element comprises a rod having a lower end and an upper end, said lower end being fixable to a first building element, and said upper end being provided with an enlarged portion pressing against an upper surface of the building element.

3. A building system according to claim 2, characterized in that at least the lower end of a rod is provided with thread.

4. A building system according to claim 3, characterized in that the upper end of each rod is provided with an enlarged portion provided with a threaded bore, in which the lower end of a threaded rod of a superimposed building element can be accommodated.

5. A building system according to claim 4, characterized in that each opening in a building element positioned close to the upper surface, lower surface or both upper and lower surfaces has a cut-out for accommodating an enlarged portion of the upper end of a rod.

6. A building system according to claim 5, characterized in that the position of the cut-out in an upper or lower surface is defined with such an accuracy that through the enlarged portion a correct positioning of the building elements with respect to each other can be obtained.

7. A building system as in any one of claims 2–6, in which said enlarged portion and a connecting element form one unit.

8. A building system as in any one of claims 2–6, in which said upper surface, lower surface or both upper and lower surfaces have gutters ending in side walls, said gutters being provided with thread and through which threaded rods can be positioned to connect said gutters of associated building elements to form a lateral connection.

9. A building system according to claim 8, characterized in that the deformation member is a ring having a conical body.

* * * * *